US010624170B2

(12) United States Patent
Janik et al.

(10) Patent No.: US 10,624,170 B2
(45) **Date of Patent: *Apr. 14, 2020**

(54) SINGLE CONTROL LED DIMMING AND WHITE TUNING

(71) Applicant: Eaton Intelligent Power Limited, Dubllin (IE)

(72) Inventors: Raymond George Janik, Fayetteville, GA (US); Russell Scott Trask, Sharpsburg, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/450,378

(22) Filed: Jun. 24, 2019

(65) Prior Publication Data

US 2019/0313499 A1 Oct. 10, 2019

Related U.S. Application Data

(63) Continuation of application No. 15/727,248, filed on Oct. 6, 2017, now Pat. No. 10,334,678.

(60) Provisional application No. 62/405,718, filed on Oct. 7, 2016.

(51) Int. Cl.
*H05B 33/08* (2020.01)

(52) U.S. Cl.
CPC ..... *H05B 33/0845* (2013.01); *H05B 33/0827* (2013.01); *H05B 33/0857* (2013.01)

(58) Field of Classification Search
CPC ..... H05B 33/0845; H05B 33/0827; H05B 33/0857
See application file for complete search history.

(56) References Cited

U.S. PATENT DOCUMENTS

| | | | | |
|---|---|---|---|---|
| 10,334,678 | B2 * | 6/2019 | Janik | H05B 33/0857 |
| 2002/0048177 | A1 | 4/2002 | Rahm et al. | |
| 2011/0249431 | A1 * | 10/2011 | Tanaka | H05B 33/0827 362/227 |
| 2012/0134148 | A1 | 5/2012 | Ter Weeme et al. | |
| 2013/0063035 | A1 * | 3/2013 | Baddela | H05B 33/086 315/192 |

(Continued)

OTHER PUBLICATIONS

Linear Technology Corporation (current regulator "LT3092") (Year: 2009).*

(Continued)

*Primary Examiner* — Renan Luque
(74) *Attorney, Agent, or Firm* — King & Spalding LLP

(57) ABSTRACT

A lighting device includes a light source that emits an illumination light. The light source includes a first group of light emitting diodes (LEDs) to emit a first light, a second group of LEDs to emit a second light, and a third group of LEDs to emit a third light. The second light is warmer light than the first light, and the third light is cooler light than the first light. The lighting device further includes a first difference amplifier that controls a first current flow through the second group of LEDs at least based on a magnitude of a current flowing through the light source. The lighting device also includes a second difference amplifier that controls a second current flow through the third group of LEDs at least based on the magnitude of the current flowing through the light source.

17 Claims, 4 Drawing Sheets

(56) References Cited

U.S. PATENT DOCUMENTS

| | | | | |
|---|---|---|---|---|
| 2016/0205741 | A1* | 7/2016 | Seki | H05B 33/0827 315/192 |
| 2017/0006680 | A1* | 1/2017 | Beijer | H05B 33/0845 |
| 2017/0171931 | A1* | 6/2017 | Seki | H05B 33/0887 |
| 2017/0181241 | A1* | 6/2017 | Koo | H05B 33/0866 |

OTHER PUBLICATIONS

Westinghouse (Can Color Temperature Affect My Mood) (Year: 2015).*
Can color temperature affect my mood; Westinghouse, Jun. 2015, pp. 1-2.

* cited by examiner

SINGLE CONTROL LED DIMMING AND WHITE TUNING

CROSS REFERENCE TO RELATED APPLICATIONS

The present application is a continuation of and claims priority to U.S. patent application Ser. No. 15/727,248, filed Oct. 6, 2017, and titled "Single Control LED Dimming And White Tuning," which claims priority under 35 U.S.C. Section 119(e) to U.S. Provisional Patent Application No. 62/405,718, filed Oct. 7, 2016, and titled "Single Control LED Dimming And White Tuning." The entire contents of all of the preceding applications are incorporated herein by reference.

TECHNICAL FIELD

The present disclosure relates generally to lighting solutions, and more particularly to a single control for light dimming and color temperature adjustment.

BACKGROUND

Some lighting fixtures are controllable to adjust both Correlated Color Temperature (CCT) and intensity level of a light emitted by the light emitting diode (LED) light source of the lighting fixtures. For example, CCT and intensity level adjustments can produce a desired light that is appropriate for particular times of a day and situation. Adjusting both CCT and intensity level of the light emitted by an LED light source often requires two separate controls. However, installing separate controls can be relatively expensive and may be inconvenient to users. In retrofit installations, structural limitations may make installing additional controls challenging. For example, installing a new CCT control in addition to an existing dimming control may be challenging because of structural constraints. Thus, the ability to control both the CCT and the intensity of a light using a dimmer control can be advantageous. Further, providing an illumination light more closely matches natural lighting when the illumination light has a cool CCT may be desirable.

SUMMARY

The present disclosure relates generally to lighting solutions, and more particularly to a single control for light dimming and color temperature adjustment. In an example embodiment, a lighting device includes a light source that emits an illumination light. The light source includes a first group of light emitting diodes (LEDs) to emit a first light, a second group of LEDs to emit a second light, and a third group of LEDs to emit a third light. The second light is warmer light than the first light, and the third light is cooler light than the first light. The lighting device further includes a first difference amplifier that controls a first current flow through the second group of LEDs at least based on a magnitude of the current flowing through the light source. The lighting device also includes a second difference amplifier that controls a second current flow through the third group of LEDs at least based on the magnitude of the current flowing through the light source.

In another example embodiment, a lighting device includes a light source that emits an illumination light. The light source includes a first group of light emitting diodes (LEDs) to emit a first light, a second group of LEDs to emit a second light, and a third group of LEDs to emit a third light. The second light is warmer light than the first light, and the third light is cooler light than the first light. The lighting device further includes a first difference amplifier that regulates a first current flow through the second group of LEDs at least based on a magnitude of a current flowing through the light source and the first current flow through the second group of LEDs. The lighting device also includes a second difference amplifier that regulates a second current flow through the third group of LEDs at least based on the magnitude of the current flowing through the light source and the second current flow through the third group of LEDs.

In another example embodiment, a lighting device includes a light source that emits an illumination light. The light source includes a first group of light emitting diodes (LEDs) to emit a first light, a second group of LEDs to emit a second light, and a third group of LEDs to emit a third light. The second light is warmer light than the first light, and the third light is cooler light than the first light. The third light includes a combination of green and blue lights having a combined CCT of approximately 6500 K. The lighting device further includes a first operational amplifier that regulates a first current flow through the second group of LEDs at least based on a magnitude of a current flowing through the light source. The lighting device also includes a second operational amplifier that regulates a second current flow through the third group of LEDs at least based on the magnitude of the current flowing through the light source.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
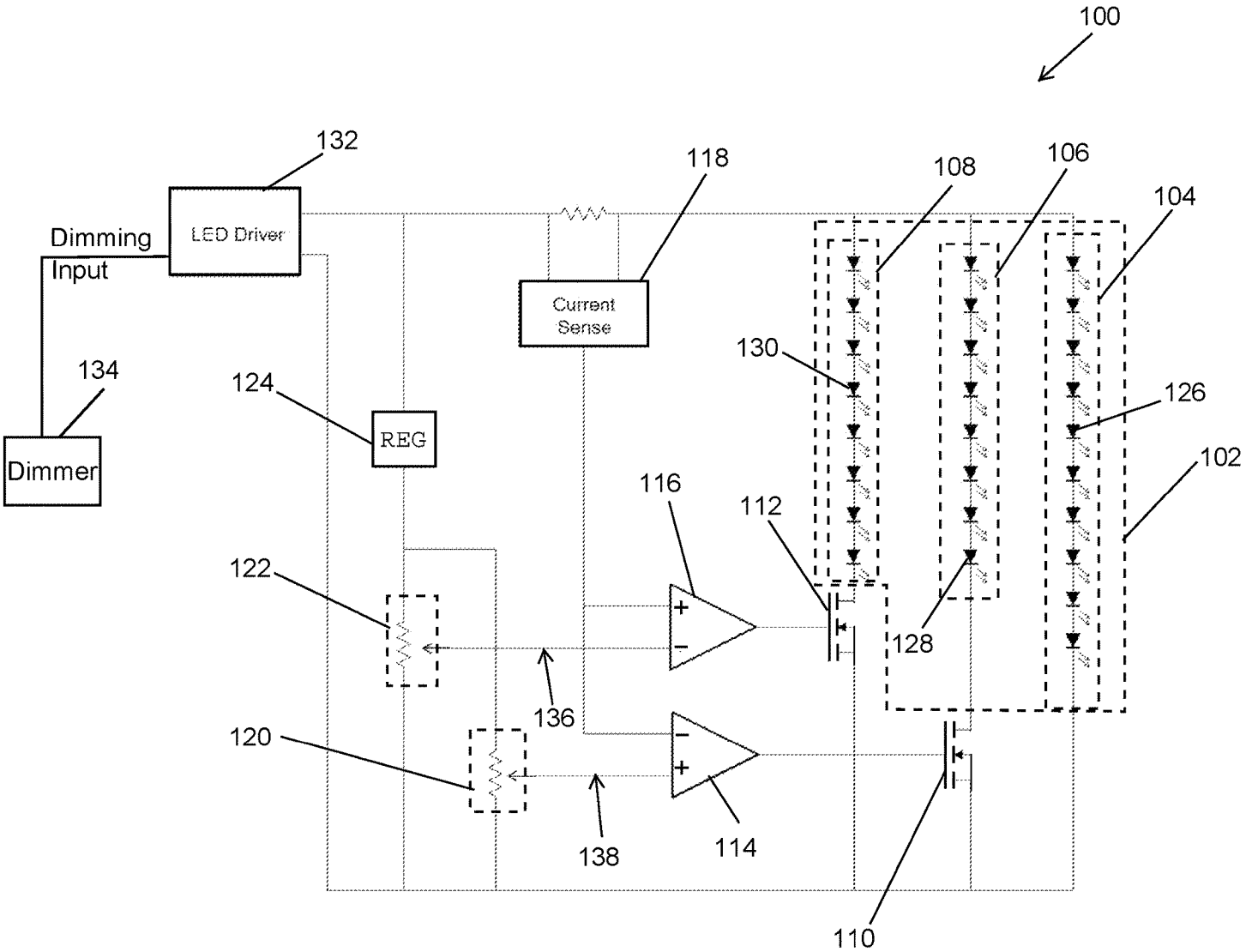
FIG. 1 illustrates a lighting device including multiple groups of LEDs according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

FIG. 1 illustrates a lighting device 100 that includes multiple groups of LEDs according to an example embodiment. In some example embodiments, the lighting device 100 includes a light source 102 that emits an illumination light. The light source 102 includes a first group of light emitting diodes (LEDs) 104, a second group of LEDs 106, and a third group of LEDs 108. Each one of the first group of LEDs 104, second group of LEDs 106, and third group of LEDs 108 may include one or more discrete LEDs, one or more organic LEDs (OLEDs), an LED chip on board that includes one or more discrete LEDs, and/or an array of discrete LEDs.

In some example embodiments, the first group of LEDs 104 includes LEDs 126 that emit a first light, the second group of LEDs 106 includes LEDs 128 that emit a second light, and the third group of LEDs 108 includes LEDs 130 that emit a third light. The first, second, and third lights together result in the illumination light provided by the lighting device 100. In some example embodiments, the LEDs 126, 128, 130 of the first, second, and third groups of LEDs 104, 106, 108 may be phosphor-converted LEDs, Direct Emission LEDs, and/or Organic LEDs.

In some example embodiments, the lighting device 100 may also include an LED driver 132 that provides, for example, a current to the light source 102. For example, the LED driver 132 may be a constant current LED driver that is controllable via a dimmer input to adjust the current provided by the LED driver 132. To illustrate, the dimmer input of the driver 132 may be coupled to a dimmer 134 (e.g., a wall-mounted dimmer, wall station, 0-10V, or phase-cut dimmer). The current provided to the light source 102 may be distributed to one or more of the first, second, and third groups of LEDs 104, 106, 108 of the light source 102. As described in more detail below, the second group of LEDs 106 and the third group of LEDs 108 may each be continuously varied between fully ON and fully OFF, inclusive, depending on the amount (i.e., magnitude) of current provided to the light source 102 by the driver 132, where the amount of current provided to the light source 102 is adjustable based on the dimming input provided to the driver 132 via the dimmer input.

In some example embodiments, the lighting device 100 includes a transistor 110 (e.g., a MOSFET) and a transistor 112 (e.g., a MOSFET). The transistor 110 may be coupled in series with the second group of LEDs 106, and the transistor 112 may be coupled in series with the third group of LEDs 108. The lighting device 100 also includes a first difference amplifier 114 and a second difference amplifier 116. For example, the first difference amplifier 114 and the second difference amplifier 116 may each be an instrumentation amplifier. The output of the difference amplifier 114 is coupled to the gate terminal of the transistor 110. The difference amplifier 114 can control current flow through the second group of LEDs 106 by controlling the resistance (thus, the transconductance) of the transistor 110. The output of the difference amplifier 116 is coupled to the gate terminal of the transistor 112, and the difference amplifier 116 can control current flow through the third group of LEDs 108 by controlling the resistance (transconductance) of the transistor 112. For example, the amount of current flowing through the transistor 110 can be increased and decreased as well as cut off by controlling the resistance (transconductance) of the transistor 110. The amount of current flowing through the transistor 112 can be increased and decreased as well as cut off by controlling the resistance (transconductance) of the transistor 112.

In some example embodiments, the lighting device 100 includes a current sensor 118 that is coupled to a LED driver 132 and senses the current provided by the LED driver 132. The output of the current sensor 118 is coupled to an input of each of the difference amplifiers 114, 116. The current sensor 118 outputs a signal having a voltage level proportional to the amount of the current provided by the LED driver 132. To illustrate, when the LED driver 132 adjusts the amount of output current as a result of dim level adjustments provided to the LED driver 132 via the dimmer input, the voltage level of the output signal from the current sensor 118 changes proportionally.

In some example embodiments, the lighting device 100 includes a voltage regulator 124 that is coupled to the output of the LED driver 132. The lighting device 100 may also include potentiometers 120, 122. The voltage regulator 124 can generate an output signal that is used to provide a first reference signal to the first difference amplifier 114 and a second reference signal to the second difference amplifier 116. To illustrate, the potentiometer 120 is coupled between the regulator 124 and the first difference amplifier 114, and the potentiometer 122 coupled between the regulator 124 and the second difference amplifier 116.

In some example embodiments, the first reference signal having a first reference voltage level is provided to the first difference amplifier 114 by the potentiometer 120 via a connection 138 (e.g., an electrical wire or trace). The first reference voltage of the first reference signal provided to the first difference amplifier 114 is dependent on the setting of the potentiometer 120. As described above, the output signal from the current sensor 118, which has a voltage level that corresponds to the amount of current provided to the light source 102 by the LED driver 132, is provided to the first difference amplifier 114. Because current flow through the second group of LEDs 106 depends on the resistance of the transistor 110, which is controlled by the output control signal from the first difference amplifier 114, the current flow through the second group of LEDs 106 is dependent on the first reference voltage of the first reference signal provided to the first difference amplifier 114.

By adjusting the potentiometer 120, the first reference voltage of the first reference signal provided to the first difference amplifier 114 may be adjusted to change a first threshold corresponding to a first amount of current from the LED driver 132 at which the transistor 110 is turned off and on. For example, current flow through the second group of LEDs 106 may be turned off when the amount of current provided by the driver 132 is at or below the first threshold. Because the amount of current provided by the driver 132 is controlled by the dimmer 134 and correlates to a brightness level of the illumination light from the lighting device 100, a threshold with respect to the current provided by the driver 132 corresponds to a threshold with respect to the brightness level of the illumination light.

In some example embodiments, the second reference signal having a second reference voltage level is provided to the second difference amplifier 116 by the potentiometer 122 via a connection 136 (e.g., an electrical wire or trace), where the second reference voltage is dependent on the setting of the potentiometer 122. Because current flow through the third group of LEDs 108 depends on the resistance of the transistor 112, which is controlled by the output control signal from the second difference amplifier 116, the current flow through the third group of LEDs 108 is dependent on the second reference voltage of the second reference signal provided to the second difference amplifier 116. By adjusting the potentiometer 122, the second reference voltage of the second reference signal may be adjusted to change a second threshold corresponding to a second amount of the current from the LED driver 132 at which the transistor 112 is turned off and on. For example, current flow through the third group of LEDs 108 may be turned on when the amount of current provided by the driver 132 is at or above the second threshold amount. The potentiometers 120, 122 may be set such that the first amount of current from the LED driver 132 corresponding to the first threshold is lower than the second amount of current from the LED driver 132 corresponding to the second threshold.

In some example embodiments, the second light emitted by the second group of LEDs 106 is warmer light than the first light emitted by the first group of LEDs 104, and the third light emitted by the third group of LEDs 108 is cooler light than the first light. For example, the first light may have a CCT of approximately 3000 K, the second light may have a combined CCT of approximately 1800 K, and the third light may have a combined CCT of approximately 6500 K. In some example embodiments, the third light emitted by the third group of LEDs 108 may include a combination of two or more of 465 nm-475 nm blue light, a cyan light, a phosphor converted (PC) green light, a PC Yellow light, a PC Red light, and Direct Emission 665 nm red light lights resulting in a combined CCT of, for example, approximately 6500 K. For example, the third light emitted by the third group of LEDs 108 may include a blue light in the range of 465 nm-475 nm, a cyan light at around 490 nm, a PC green light, and another other color LED light that enable the illumination light to more closely match daylight. By using a combination of green and blue lights, the illumination light from the light source 102 of the lighting device 100 may have a desired CCT that reasonably replicates daylight and may also have a higher intensity at around 475 nm than ordinarily provided by standard LED light.

In some example embodiments, the second group of LEDs 106 emits a light that influences the illumination light from the lighting device 100 to have a CCT that is closer to a warm white light (e.g., 1700 K, 1800 K, etc.) on the black-body curve, and the third group of LEDs 108 emits a light that influences the illumination light to have a CCT that is closer to a cool white light (e.g., 6000 K, 6500 K, etc.) on the black-body curve. By adjusting the first threshold amount of current provided to the light source 102 at which the transistor 110 is turned off or on, the contribution of the second light emitted by the second group of LEDs 106 to the CCT and dim level of the illumination light may be controlled. By adjusting the second threshold amount of current provided to the light source 102 at which the transistor 112 is turned off or on, the contribution of the third light emitted by the third group of LEDs 108 to the CCT and dim level of the illumination light may be controlled. The CCT and dim level of the illumination light both are thus adjustable using a dim level input of the driver 132.

In some example embodiments, the forward voltage required to turn on the first group of LEDs 104 is higher than the forward voltage required to turn on the second group of LEDs 106 and/or the forward voltage required to turn on the third group of LEDs 108. To illustrate, the forward voltage across the first group of LEDs 104 may be higher than the forward voltage across the second group of LEDs 106 by an equivalent of a forward voltage required to turn on one or more LEDs. To illustrate, as the current provided by the LED driver 132 is reduced due to dimming (e.g., by changing dim level setting provided via the dimmer input of the LED driver 132), the second light from the second group of LEDs 106 may remain on while the first light from the first group of LEDs 104 is turned off because of the higher forward voltage requirement of the first group of LEDs.

In some example embodiments, the LED driver 132 may serve as a voltage source instead of a current source without departing from the scope of this disclosure. For example, a voltage to current converter may be provided at the output of a constant voltage driver. Although the transistors 110, 112 are shown as MOSFETs, in alternative embodiments, the transistors 110, 112 may be another type of transistor without departing from the scope of this disclosure. In some alternative embodiments, the transistors 110, 112 may be coupled on the high side of the lighting device 100 without departing from the scope of this disclosure. In some alternative embodiments, the current sensor 118 may be coupled on the low side of the lighting device 100 without departing from the scope of this disclosure. In some example embodiments, the light source 102 may include other groups of LEDs without departing from the scope of this disclosure. In some alternative embodiments, each group of LEDs of the light source 102 may include more or fewer LEDs than shown without departing from the scope of this disclosure. In some alternative embodiments, the light source 103 may include non-LED light sources without departing from the scope of this disclosure. In some example embodiments, the lighting device 100 may include other components, and some components of the lighting device 100 may be omitted and/or integrated into a single component without departing from the scope of this disclosure. In some example embodiments, the lighting device 100 may be a lighting fixture that is coupled to a dimmer or that has an integrated dimmer.

Figure 2:
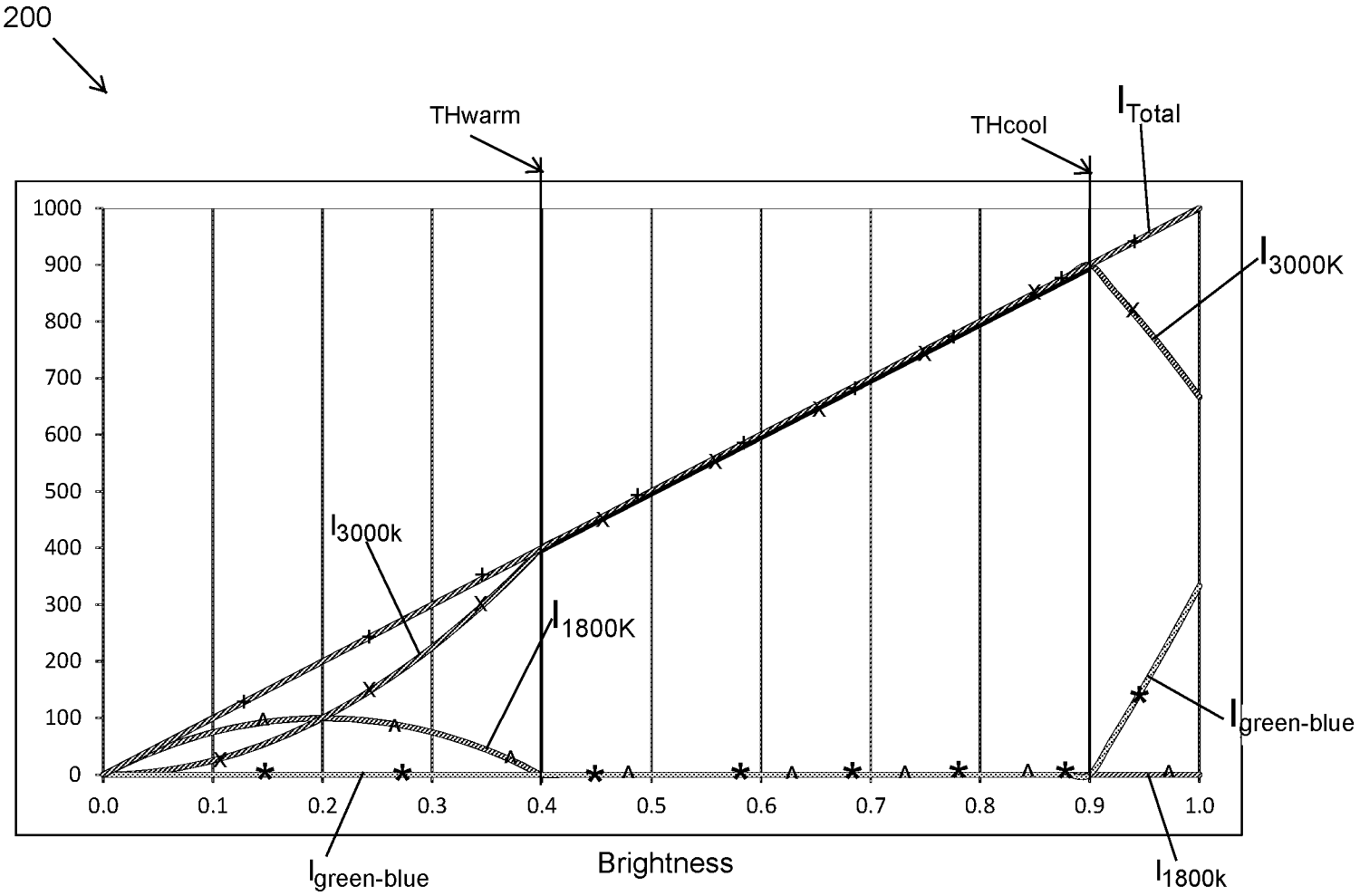
FIG. 2 is a graph illustrating allocation of current to different groups of LEDs of the LED light source of the lighting device of FIG. 1 relative to brightness/dimming level according to an example embodiment.

FIG. 2 is a graph 200 illustrating allocation of current to different groups of LEDs of the light source 102 of FIG. 1 relative to brightness level of the illumination light from the light source 102 according to an example embodiment. Referring to FIGS. 1 and 2, in some example embodiments, the LED driver 132 provides a current, $I_{total}$, to the light source 102. The amount of the current, $I_{total}$, is adjustable based on the dim level setting of the dimmer 134. As the amount of the current, $I_{total}$, increases, the brightness level of the illumination light provided by the light source 102 correspondingly increases. As the amount of the current, $I_{total}$, decreases, the brightness level of the illumination light provided by the light source 102 correspondingly decreases.

Because the current, $I_{total}$, is distributed among one or more of the first group of LEDs 104, the second group of LEDs 106, and the third group of LEDs 108, the current, $I_{total}$, is a sum of the current, $I_{3000}$, through the first group of LEDs 104, the current, $I_{1800}$, through the second group of LEDs 106, and the current, $I_{green\text{-}blue}$, through the third group of LEDs 108. For example, the light emitted by the first group of LEDs 104 may have a CCT of approximately 3000 K, the light emitted by the second group of LEDs 106 may have a CCT of approximately 1800 K, and the light emitted by the third group of LEDs 108 may include a combination of green-blue lights resulting in a CCT of approximately 6500 K.

As described above with respect to FIG. 1, the amount of current, $I_{total}$, provided by the driver 132 at which the second group of LEDs 106 are turned on and off depends on a threshold (THwarm) controlled by the potentiometer 120. The amount of current, $I_{total}$, provided by the driver 132 at which the third group of LEDs 108 are turned on and off depends on a threshold (THcool) controlled by the potentiometer 122. For example, the threshold (THwarm) at which the second group of LEDs 106 are turned on and off may be set to correspond to approximately 40% of the brightness level of the illumination light provided by the lighting device 100, and the threshold (THcool) at which the third group of LEDs 108 are turned on and off may be set to correspond to approximately 90% of the brightness level of the illumination light provided by the lighting device 100. Moving from left to right on the graph 200, as the current, $I_{total}$, provided by the driver 132 is increased reaching the threshold, THwarm, the current, $I_{1800}$, through the second group of LEDs 106 goes to zero. To illustrate, as the current, $I_{total}$, is increased, for example, by changing a setting of the dimmer 134, the difference amplifier 114 of the lighting device 100 increases the resistance of the transistor 110, thereby reducing the current, $I_{1800}$, until the transistor 110 is fully turned off when the current, $I_{total}$, reaches the threshold, THwarm. At the threshold, THwarm, the current, $I_{green\text{-}blue}$, through the third group of LEDs 108 remains zero and the current, $I_{total}$, matches the current, $I_{3000}$, provided to the first group of LEDs 104. Thus, the illumination light provided by the light source 102 becomes less warm when the amount of current, $I_{total}$, is increased to the threshold, THwarm and becomes warmer when the amount of current, $I_{total}$, is decreased below the threshold, THwarm.

As illustrated in FIG. 2, the current, $I_{green\text{-}blue}$, through the third group of LEDs 108 remains at zero until the current, $I_{total}$, is increased (e.g., by adjusting the dimmer 134) reaching the threshold, THcool. As the current, $I_{total}$, is increased above the threshold, THcool, the current, $I_{total}$, provided by the LED driver 132 is split into the current, I3000, through the first group of LEDs 104 and the current, $I_{green\text{-}blue}$, through the third group of LEDs 108. To illustrate, as the current, $I_{total}$, is increased above the threshold, THcool, by adjusting the dimmer 134 to increase the brightness level of the illumination light provided by the light source 102, the difference amplifier 116 of the lighting device 100 decreases the resistance of the transistor 112, thereby increasing the amount of the current, $I_{green\text{-}blue}$, through the third group of LEDs 108, which results in reducing the current, $I_{3000}$. Thus, the illumination light provided by the light source 102 becomes more cool when the amount of current, $I_{total}$, is increased above threshold, THcool, (i.e., as the illumination light becomes brighter) and becomes less cool when the amount of current, $I_{total}$, is decreased toward the threshold, THcool (i.e., as the illumination light less brighter).

Moving from right to left on the graph 200, as the current, $I_{total}$, provided by the driver 132 is reduced down to the threshold, THcool, and the brightness level of the illumination light is correspondingly reduced, the current, $I_{green\text{-}blue}$, through the third group of LEDs 108 reaches zero, where the current, $I_{total}$, matches the current, $I_{3000}$, flowing through the first group of LEDs 104. Thus, the illumination light provided by the light source 102 becomes less cool when the amount of current, $I_{total}$, is decreased toward the threshold, THcool (i.e., as the illumination light less brighter).

As the current, $I_{total}$, is decreased further to the threshold, THwarm, the second group of LEDs 106 and the third group of LEDs 108 remain off and do not contribute to the CCT of the illumination light provided by the light source 102. Thus, between the threshold, THwarm, and the threshold, THcool, the current, $I_{total}$, matches the current, I3000, as the difference amplifiers 114, 116 respectively keep the transistors 110, 112 turned off. As the current, $I_{total}$, is decreased further to below the threshold, THwarm, the current, $I_{total}$, is split into the current, $I_{3000}$, and the current, $I_{1800}$, provided to the third group of LEDs 108. As the resistance (thus, the transconductance) of the transistor 110 is reduced further as a result of the current, $I_{total}$, decreasing below the threshold, THwarm, the illumination light provided by the light source 102 becomes warmer.

By changing the setting of the potentiometer 120, the threshold, THwarm, may be changed higher or lower. The threshold, THcool, may also be changed higher or lower by changing the setting of the potentiometer 122. The range of the current, $I_{total}$, that is between the threshold, THwarm, and the threshold, THcool, may thus be changed by changing one or both of the threshold, THwarm, and the threshold, THcool.

The threshold, THwarm, and the threshold, THcool, values shown in FIG. 2 and described above are non-limiting examples, and the threshold, THwarm, and the threshold, THcool, values may be set to a different brightness (conversely, dim) levels that correspond to amounts of the current, $I_{total}$, provided to the light source 102.

Figure 3:
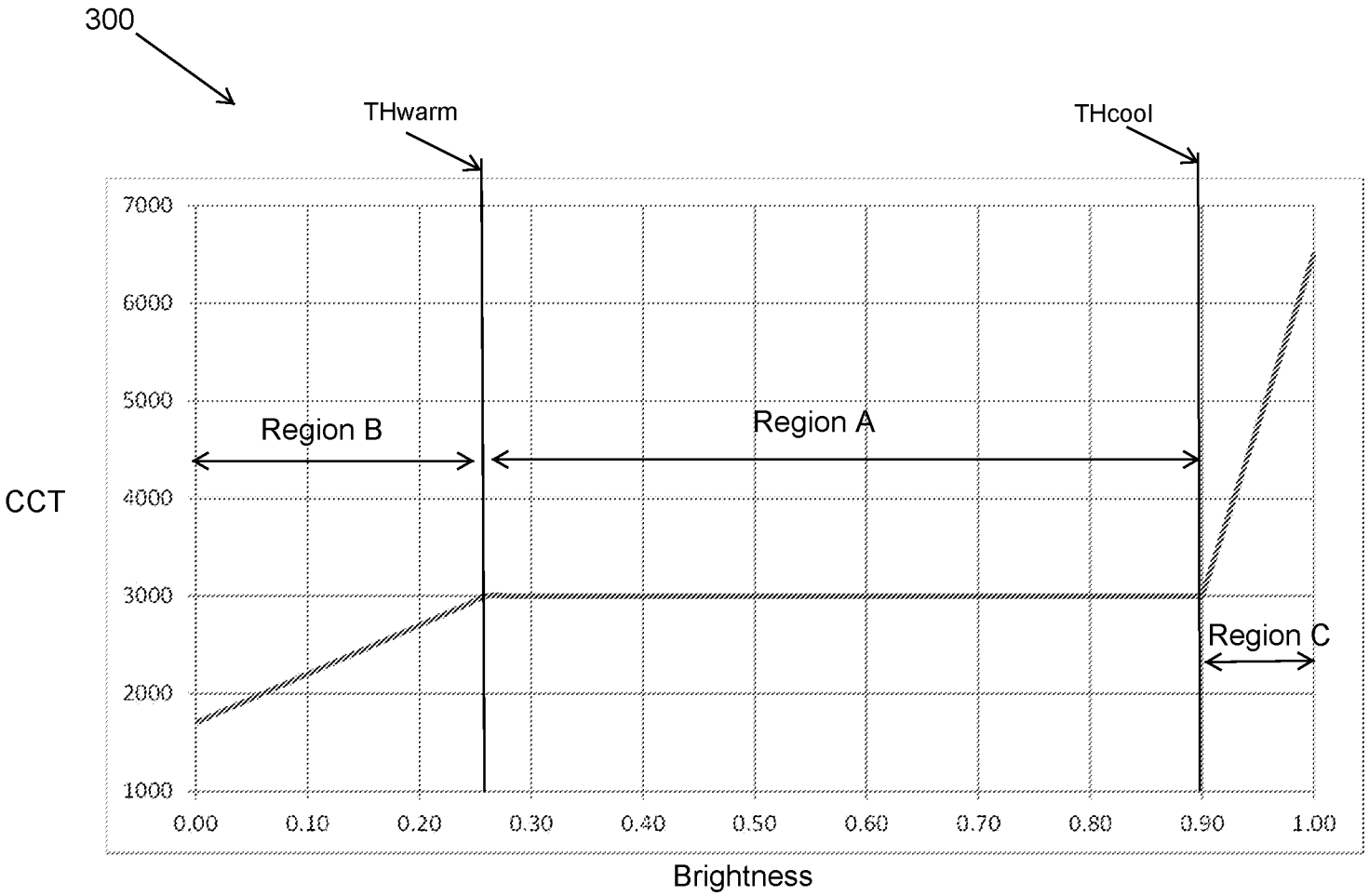
FIG. 3 is a graph illustrating CCT of light emitted by the light device of FIG. 1 relative to dimming level according to an example embodiment.

FIG. 3 is a graph 300 illustrating CCT of light emitted by the lighting device of FIG. 1 relative to brightness level according to an example embodiment. Referring to FIGS. 1-3, Region A represents a range of brightness/dim level settings of the lighting device 100 intended to achieve an illumination light of the lighting device 100 that may be desirable after dusk and in the evenings. Region B represents a range of brightness/dim level settings of the lighting device 100 intended to achieve an illumination light that may be desirable in the evenings as background low level, low CCT lighting. Region C represents a dim level setting of the lighting device 100 intended to achieve an illumination light that may be desirable during the day when maximum lighting is required to match daylight. As described above, the regions A, B, C, may be changed by changing one or both of the threshold, THwarm, and the threshold, THcool, using the settings of the potentiometers 120, 122.

Figure 4:
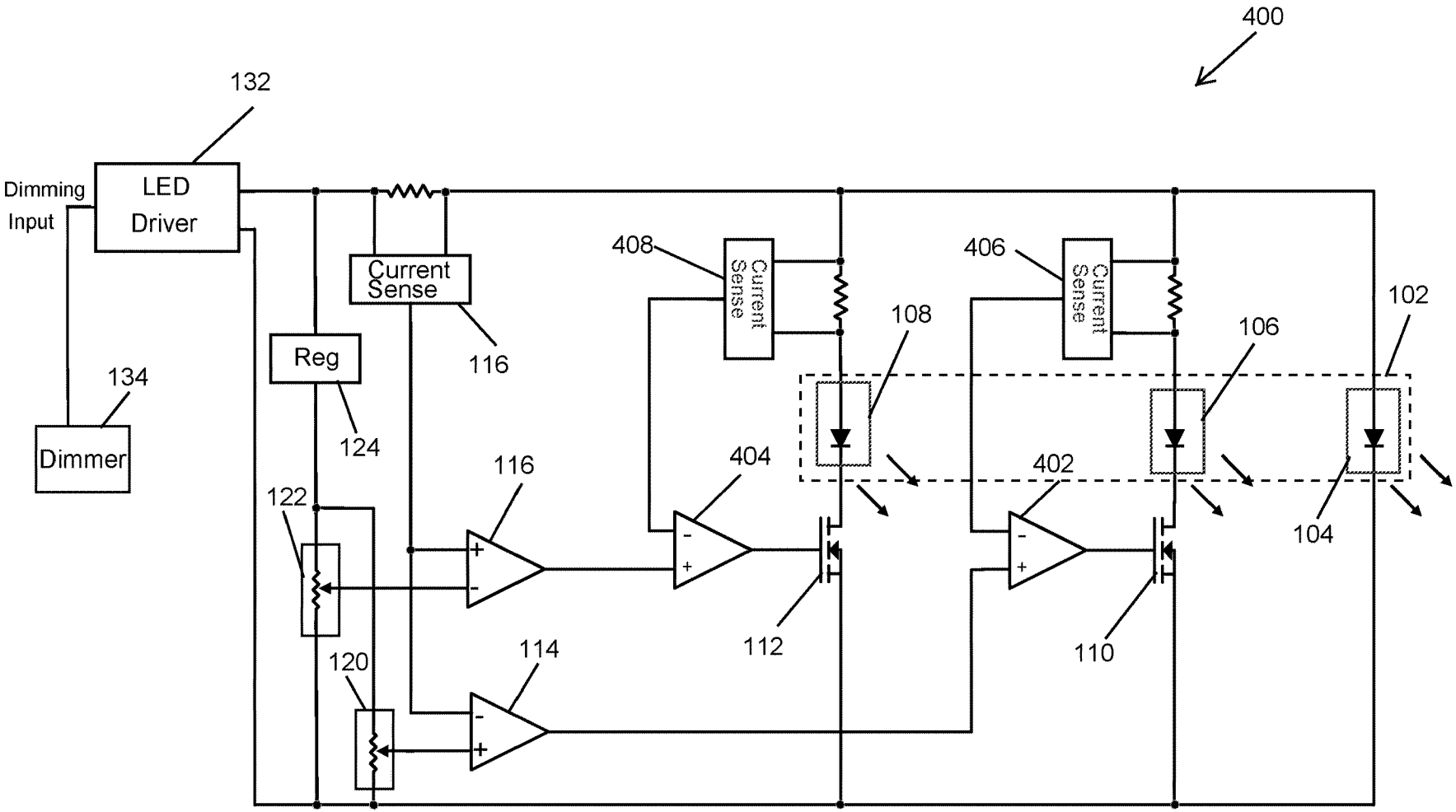
FIG. 4 illustrates a lighting device including multiple groups of LEDs according to another example embodiment.

FIG. 4 illustrates a lighting device 400 that includes multiple groups of LEDs according to another example embodiment. In some example embodiments, the lighting device 400 generally operates in a similar manner as described with respect to the lighting device 100. To illustrate, the lighting device 400 includes the light source 102, the first difference amplifier 114, the second difference amplifier 116, the current sensor 118, and the LED driver 132. The light source 102 includes the first group of LEDs 104, the second group of LEDs 106, and the third group of LEDs 108. The lighting device 400 also includes the transistor 110 that is coupled in series with the second group of LEDs 106, and the transistor 112 that is coupled in series with the third group of LEDs 108.

In some example embodiments, the lighting device 400 also includes operational amplifiers (Op Amps) 402, 404, and current sensors 406, 408. In contrast to the lighting device 100, the output of the difference amplifier 114 is coupled to an input of the operational amplifier 402 instead of to the gate terminal of the transistor 110, and the output of the difference amplifier 116 is coupled to an input of the operational amplifier 404 instead of the gate terminal of the transistor 112. The difference amplifier 114 and the operational amplifier 402 function as a current regulator for the current flowing through the second group of LEDs 106, thereby compensating for drifts due to, for example, temperature. The difference amplifier 116 and the operational amplifier 404 function as a current regulator for the current flowing through the third group of LEDs 108, thereby compensating for drifts due to, for example, temperature. The output of the current sensor 406 is coupled to the other input of the operational amplifier 402, and the output of the current sensor 408 is coupled to the other input of the operational amplifier 404. The gate terminal of the transistor 110 is coupled to the output of the operational amplifier 402, and the gate terminal of the transistor 112 is coupled to the output of the operational amplifier 404. The current sensor 406 is coupled the second group of LEDs 106 such that an output signal of the current sensor 406 provided to the operational amplifier 402 has a voltage level that corresponds to the current provided to the second group of LEDs 106. Because the output signal of the operational amplifier 402 provided to the gate terminal of the transistor 110 depends on the output signal of the current sensor 406, the operational amplifier 402 accounts for changes in the second group of LEDs 106 (e.g., changes due to temperature) that affect current flow through the second group of LEDs 106. Because the output signal of the operational amplifier 402 provided to the gate terminal of the transistor 110 also depends on the amount of current provided by the driver 132, the threshold amount of current provided by the driver 132 and at which the transistor 110 is turned off and on depends on the setting of the potentiometer 120 as described with respect to the lighting device 100 and FIGS. 1-3.

The current sensor 408 is coupled the third group of LEDs 108 such that an output signal of the current sensor 408 provided to the operational amplifier 404 has a voltage level that corresponds to the current provided to the third group of LEDs 108. Because the output signal of the operational amplifier 402 provided to the gate terminal of the transistor 112 depends on the output signal of the current sensor 408, the operational amplifier 404 accounts for changes in the third group of LEDs 108 (e.g., changes due to temperatures of the first and/or third groups of LEDs 104, 108) that affect current flow through the third group of LEDs 108. Because the output signal of the operational amplifier 404 provided to the gate terminal of the transistor 112 also depends on the amount of current provided by the driver 132, the threshold amount of current provided by the driver 132 and at which the transistor 112 is turned off and on depends on the setting of the potentiometer 122 as described with respect to the lighting device 100 and FIGS. 1-3.

By adjusting the threshold amount of the current provided to the light source 102 at which the transistor 110 is turned off and on, the contribution of the second light emitted by the second group of LEDs 106 to the CCT and dim level of the illumination light may be controlled. By adjusting the threshold amount of the current provided to the light source 102 at which the transistor 112 is turned off and on, the contribution of the third light emitted by the third group of LEDs 108 to the CCT and dim level of the illumination light may be controlled. The CCT and dim level of the illumination light both are thus adjustable using a dim level input of the driver 132.

In some example embodiments, the LED driver 132 may serve as a voltage source instead of a current source without departing from the scope of this disclosure. For example, a voltage to current converter may be provided at the output of a constant voltage driver. Although the transistors 110, 112 are shown as MOSFETs, in alternative embodiments, the transistors 110, 112 may be another type of transistor without departing from the scope of this disclosure. In some alternative embodiments, the transistors 110, 112 may be coupled on the high side of the lighting device 100 without departing from the scope of this disclosure. In some alternative embodiments, the current sensor 118 may be coupled on the low side of the lighting device 100 without departing from the scope of this disclosure.

In some alternative embodiments, one or both the current sensors 406, 408 may be coupled on the low side of the lighting device 100 without departing from the scope of this disclosure. In some example embodiments, the light source 102 may include other groups of LEDs without departing from the scope of this disclosure. In some alternative embodiments, each group of LEDs of the light source 102 may include more or fewer LEDs than shown without departing from the scope of this disclosure. In some alternative embodiments, the light source 102 may include non-LED light sources without departing from the scope of this disclosure. In some example embodiments, the lighting device 100 may include other components, and some components of the lighting device 100 may be omitted and/or integrated into a single component without departing from the scope of this disclosure.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a light source that emits an illumination light, the light source comprising a first group of light emitting diodes (LEDs) to emit a first light, a second group of LEDs to emit a second light, and a third group of LEDs to emit a third light, wherein the second light is warmer light than the first light and wherein the third light is cooler light than the first light;

a first difference amplifier that controls a first current flow through the second group of LEDs at least based on a first adjustable reference signal and a current flowing through the light source, wherein the current flowing through the light source includes a total of currents flowing through the first group of LEDs, the second group of LEDs, and the third group of LEDs; and a second difference amplifier that controls a second current flow through the third group of LEDs at least based on a second adjustable reference signal and the current flowing through the light source, wherein the second group of LEDs and the third group of LEDs are off when a magnitude of the current flowing through the light source is between a first threshold and a second threshold and wherein the first threshold and the second threshold are adjustable by adjusting the first adjustable reference signal and the second adjustable reference signal.

2. The lighting device of claim 1, wherein the second group of LEDs emits the second light when the magnitude of the current flowing through the light source is below the first threshold and wherein the third group of LEDs emits the third light when the magnitude of the current flowing through the light source is above the second threshold.

3. The lighting device of claim 1, further comprising:

a first transistor coupled in series with the second group of LEDs; and a second transistor coupled in series with the third group of LEDs, wherein the first difference amplifier adjusts the first current flow through the second group of LEDs based on the first threshold by controlling the first transistor and wherein the second difference amplifier adjusts the second current flow through the third group of LEDs based on the second threshold by controlling the second transistor.

4. The lighting device of claim 1, further comprising an LED driver that provides the current to the light source, wherein the magnitude of the current flowing through the light source depends on a dimming input provided to the LED driver.

5. The lighting device of claim 1, further comprising a current sensor that is configured to generate an output signal that is provided to the first difference amplifier and to the second difference amplifier, the output signal having a voltage level corresponding to the magnitude of the current flowing through the light source.

6. The lighting device of claim 4, further comprising a regulator electrically coupled to the LED driver and configured to generate a regulator output signal, wherein the first adjustable reference signal has a first reference voltage and is derived from the regulator output signal, wherein the first adjustable reference signal is provided to the first difference amplifier, wherein the second adjustable reference signal has a second reference voltage and is derived from the regulator output signal, and wherein the second adjustable reference signal is provided to the second difference amplifier.

7. The lighting device of claim 6, wherein adjusting the first adjustable reference signal includes adjusting the first reference voltage that results in changing the first threshold and wherein adjusting the second adjustable reference signal includes adjusting the second reference voltage that results in the second threshold.

8. The lighting device of claim 1, wherein the first light has approximately 3000 K CCT, wherein the second light has approximately 1800 K CCT, wherein the third light has approximately 6500 K CCT, and wherein the third light includes a combination of green and blue lights.

9. The lighting device of claim 1, further comprising:

a first operational amplifier that regulates the first current flow through the second group of LEDs at least based on the first current flow through the second group of LEDs and an output signal of the first difference amplifier; and a second operational amplifier that regulates the second current flow through the third group of LEDs at least based on the second current flow through the third group of LEDs and an output signal of the second difference amplifier.

10. A lighting device, comprising:

a light source that emits an illumination light, the light source comprising a first group of light emitting diodes (LEDs) to emit a first light, a second group of LEDs to emit a second light, and a third group of LEDs to emit a third light, wherein the second light is warmer light than the first light and wherein the third light is cooler light than the first light;

a first operational amplifier that regulates a flow of a first current through the second group of LEDs at least based on a first adjustable reference signal, a current flowing through the light source, and a first output signal generated by a first current sensor from the first current through the second group of LEDs, wherein the first output signal is independent of a first path current flowing through the first group of LEDs, wherein the current flowing through the light source includes a total of currents flowing through the first group of LEDs, the second group of LEDs, and the third group of LEDs; and a second operational amplifier that regulates a second current flow through the third group of LEDs at least based on a second adjustable reference signal, the current flowing through the light source, and a second output signal generated by a second current sensor from the second current flowing through the third group of LEDs, wherein the second output signal is independent of the first path current flowing through the first group of LEDs, wherein the second group of LEDs emits the second light when a magnitude of the current flowing through the light source is below a first threshold, and wherein the third group of LEDs emits the third light when the magnitude of the current flowing through the light source is above a second threshold.

11. The lighting device of claim 10, wherein the second group of LEDs and the third group of LEDs are off when the magnitude of the current flowing through the light source is between the first threshold and the second threshold.

12. The lighting device of claim 11, wherein the first threshold and the second threshold are adjustable by adjusting the first adjustable reference signal and the second adjustable reference signal.

13. The lighting device of claim 10, further comprising an LED driver that provides the current to the light source, wherein the magnitude of the current flowing through the light source depends on a dimming input provided to the LED driver.

14. The lighting device of claim 13, further comprising a third current sensor coupled to the LED driver, the third current sensor to generate a third output signal provided to a first difference amplifier and to a second difference amplifier, the third output signal having a voltage level corresponding to the magnitude of current flowing through the light source, wherein an output signal of the first difference amplifier is provided to the first operational amplifier and wherein an output signal of the second difference amplifier is provided to the second operational amplifier.

15. The lighting device of claim 10, wherein the first light has approximately 3000 K CCT, wherein the second light has approximately 1800 K CCT, wherein the third light has approximately 6500 K CCT, and wherein the third light includes a combination of green and blue lights.

16. A lighting device, comprising:

a light source that emits an illumination light, the light source comprising a first group of light emitting diodes (LEDs) to emit a first light, a second group of LEDs to emit a second light, and a third group of LEDs to emit a third light, wherein the second light is warmer light than the first light and wherein the third light is cooler light than the first light, and wherein the third light includes a combination of green and blue lights having a CCT of approximately 6500 K;

a first operational amplifier that controls a first current flow through the second group of LEDs at least based on a first adjustable reference signal and a current flowing through the light source, wherein the current flowing through the light source includes a total of currents flowing through the first group of LEDs, the second group of LEDs, and the third group of LEDs; and a second operational amplifier that controls a second current flow through the third group of LEDs at least based on a second adjustable reference signal and the current flowing through the light source, wherein the second group of LEDs and the third group of LEDs are off when a magnitude of the current flowing through the light source is between a first adjustable threshold and a second adjustable threshold.

17. The lighting device of claim 16, wherein the first light has approximately 3000 K CCT and wherein the second light has approximately 1800 K CCT.

* * * * *